US007400849B2

(12) United States Patent
Tamura

(10) Patent No.: US 7,400,849 B2
(45) Date of Patent: Jul. 15, 2008

(54) IMAGE FORMING APPARATUS WITH A MAGNETIC ONE-COMPONENT TONER

(75) Inventor: Hidekazu Tamura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 404 days.

(21) Appl. No.: 11/165,526

(22) Filed: Jun. 23, 2005

(65) Prior Publication Data

US 2005/0287456 A1 Dec. 29, 2005

(30) Foreign Application Priority Data

Jun. 24, 2004 (JP) ..... 2004-185907

(51) Int. Cl.
*G03G 15/09* (2006.01)

(52) U.S. Cl. ..... 399/276; 430/106.1

(58) Field of Classification Search ..... 430/106.1; 399/276

See application file for complete search history.

(56) References Cited

U.S. PATENT DOCUMENTS

| | | | | |
|---|---|---|---|---|
| 6,589,701 | B2 | 7/2003 | Yamazaki et al. | |
| 6,849,369 | B2 | 2/2005 | Yagi et al. | |
| 6,879,793 | B2 | 4/2005 | Chiba et al. | |
| 2002/0055052 | A1* | 5/2002 | Komoto et al. | 430/108.22 |
| 2005/0026060 | A1* | 2/2005 | Ogawa et al. | 430/106.1 |
| 2005/0051753 | A1* | 3/2005 | Hayashi et al. | 252/62.56 |

FOREIGN PATENT DOCUMENTS

| | | |
|---|---|---|
| CN | 1344977 A | 4/2002 |
| CN | 1416025 A | 5/2003 |
| CN | 1480797 | 3/2004 |
| JP | 02-157027 | 6/1990 |
| JP | 02-236566 | 9/1990 |
| JP | 02-300763 | 12/1990 |
| JP | 05-289398 | 11/1993 |
| JP | 2000-029239 | 1/2000 |
| JP | 2002-091142 | 3/2002 |

OTHER PUBLICATIONS

Chinese language office action and its English translation for corresponding Chinese patent application No. 2005100788449 lists the references above.

* cited by examiner

*Primary Examiner*—John L Goodrow
(74) *Attorney, Agent, or Firm*—Hogan & Hartson LLP

(57) ABSTRACT

A magnetic one-component toner of the invention contains at least a binding resin and a magnetic powder, and has a volume average particle size of 6.0 to 9.0 μm, a compressibility of 15 to 50%, and a mean roundness of 0.950 to 0.960. The magnetic powder has at its surface a phosphorus element of 0.10 to 0.50% by weight. This toner is suitable for use in an image forming apparatus provided with a developer carrier made of stainless steel, or an image forming apparatus provided with an amorphous silicon photosensitive material. This toner has high transfer efficiency and less fog, thereby enabling to maintain image density for a long period of time, and form high image-quality image.

8 Claims, No Drawings

IMAGE FORMING APPARATUS WITH A MAGNETIC ONE-COMPONENT TONER

Priority is claimed to Japanese Patent Application No. 2004-185907 filed on Jun. 24, 2004, the disclosure of which is incorporated by reference in its entirety.

BACKGROUND OF THE INVENTION

1. Field of the Invention

The present invention relates to a magnetic one-component toner for use in image forming apparatuses, such as copying machines, printers and facsimiles, employing electrophotography method, electrostatic storage method, or the like.

2. Description of Related Art

Generally in image forming methods such as electrophotography method and electrostatic storage method, the surface of a photosensitive material is charged by corona discharge or the like, and then exposed by laser or the like to form an electrostatic latent image. This electrostatic latent image is then developed with a toner to form a toner image. This toner image is then transferred to a storage medium to obtain a high quality image. This image forming method often employs a powdered magnetic one-component toner, which can be obtained by adding a coloring agent, charge control agent, release agent, magnetic powder, etc. to a binding resin composed of a thermoplastic resin, etc., followed by kneading, grinding and classification.

To achieve high quality image, the above magnetic one-component toner calls for miniaturization of particle size. However, there arises the problem that the miniaturization of particle size deteriorates toner flowability. As a method of solving this problem, Japanese Patent Application Publication Laid-Open Nos. 2-236566, 2-157027, and 2-300763 disclose methods of adding an additive, and describe the conditions under which the additive is blended with a toner, and the form of the additive. Unfortunately, such a method of adding an additive is insufficient to improve the flowability of the miniaturized toner. Hence, an improved method is demanded.

On the other hand, Japanese Patent Application Publication Laid-Open No. 5-289398 discloses a method in which the volume average particle size of toner is set to a specific value, and compressibility is adjusted to not more than 30%. However, there arises the problem that when the compressibility is too small, a toner layer on a sleeve is apt to be nonuniform, making it difficult to achieve a uniform image.

Japanese Patent Application Publication Laid-Open No. 2000-29239 discloses a method in which the mean roundness of a toner manufactured by grinding process is adjusted to a specific value. This toner seems to have higher transfer efficiency. For this reason, when this toner is used in a developing apparatus provided with a developing sleeve of high charge applying force, the toner in the vicinity of the surface of the developing sleeve has an extremely high charge and, under reflection force it is strongly attracted to the sleeve surface, resulting in an immobile layer. This decreases the chance that the toner is rubbed with the sleeve, thereby inhibiting the charge application. As a result, due to nonuniform charge of the toner, a toner thin layer formed on the developing sleeve causes turbulence and lack of uniformity to deteriorate image quality.

Japanese Patent Application Publication Laid-Open No. 2002-91142 discloses a developing apparatus construction and a method of adjusting the particles size, flowability, and compressibility of a toner to a specific value. However, because this toner is ground by a jet stream grinder, its mean roundness is low. When this toner is miniaturized, its flowability is lowered, which can cause the toner density drop.

SUMMARY OF THE INVENTION

A main advantage of the present invention is to provide a magnetic one-component toner having high transfer efficiency and less fog, which can maintain image density for a long period of time and also form high quality images.

The present inventor has made many research efforts for solving the above problems, and has completed the present invention by finding out the following fact. Specifically, by controlling the volume average particle size, compressibility, and mean roundness of a magnetic powder to a predetermined range, high transfer efficiency and less fog are attainable, and it is possible to maintain image density for a long period of time, and form high quality images.

More specifically, a magnetic one-component toner of the invention contains at least a binding resin and a magnetic powder, and has a volume average particle size of 6.0 to 9.0 μm, a compressibility of 15 to 50%, and a mean roundness of 0.950 to 0.960. The magnetic powder has at its surface a phosphorus element of 0.10 to 0.50% by weight.

The magnetic one-component toner satisfying the above-mentioned conditions permits higher transfer efficiency and less fog, and enables to maintain image density. Moreover, a toner thin layer formed on a developer carrier is less susceptible to turbulence. This enables a stable formation of excellent image for a long period of time.

The use of the toner of the invention allows a stable formation of excellent image for a long period of time, even for a developing sleeve made of stainless steel that has the difficulty in adjusting the amount of charge, or even for an amorphous silicon photosensitive material that is often a low-potential phenomenon. Accordingly, the magnetic one-component toner of the invention is suitable for use in an image forming apparatus provided with a developer carrier made of stainless steel, or an image forming apparatus provided with an amorphous silicon photosensitive material.

Other objects and advantages of this invention will be made apparent as the following detailed description progresses.

DETAILED DESCRIPTION OF PREFERRED EMBODIMENTS

The following is a detailed description of a magnetic one-component toner of the present invention. A magnetic one-component toner of the invention contains at least a binding resin and a magnetic powder, to which various toner compounding agents such as a coloring agent, a charge control agent and a wax are added as needed. With a kneader such as an extruder, the mixture so obtained is melted and kneaded, followed by cooling, grinding, and classification, to obtain this magnetic one-component toner. Examples of the grinder for manufacturing this toner are high-speed rotating mills, such as a "Turbo-mill," the product name of Turbo Kogyo Co., Ltd., and a "Cryptron," the product name of Kawasaki Heavy Industries Limited.

The toner of the invention has a volume average particle size of 6.0 to 9.0 μm. This enables to form a high image-quality image. When the volume average particle size is less than 6.0 μm, the flowability is deteriorated and, as printing progresses, the supply of toner onto a sleeve becomes insufficient, failing to maintain image density. When the volume average particle size is greater than 9.0 μm, it is difficult to uniformly apply charge on the sleeve, and it is difficult to exactly reproduce a latent image such as a fine line, resulting in poor image quality.

In the present invention, as will be described later, the volume average particle size can be determined by measuring an electrolyte, in which the above-mentioned toner is suspended together with a predetermined surface active agent, at an aperture diameter of 100 μm by using a "Coulter Counter TA-II type," the product name of Coullter Co. Ltd.

The toner of the invention has a compressibility of 15 to 50%. This provides a uniform toner layer on the sleeve. When the compressibility is less than 15%, the toner layer on the sleeve is apt to be nonuniform, and therefore the uniformity of image is lowered. When the compressibility is greater than 50%, the toner is easily compressible in the vicinity of the back of a developing blade, so that the supply of the toner onto the sleeve is insufficient. As a result, the toner density cannot be maintained, and fog is apt to occur. The fog becomes greater as the particle size of the toner is smaller.

In the present invention, as will be described later, the compressibility can be determined through the following steps by using a "Powder Tester," the product name of Hosokawa Micron Co., Ltd.

(A) The toner is vibrated so as to drop naturally and allowed to fill a cylindrical container. In this state, a slack apparent specific gravity A is found.

(B) Subsequently, the toner is allowed to drop in the same manner as above (A), while tapping the cylindrical container in above (A), so as to increase filling factor. Then, a solid apparent specific gravity is found.

(C) Compressibility is calculated by applying the obtained slack apparent specific gravity A and the solid apparent specific gravity P to the following equation:

$$\text{Compressibility (\%)}=[\{P-A\}/P]\times 100$$

Additionally, the toner of the invention has a mean roundness of 0.950 to 0.960. This suppresses the image density drop. When the mean roundness is smaller than 0.950, the flowability will deteriorate, the transfer efficiency is low, and the image density is apt to drop. When the mean roundness is larger than 0.960, the flowability and the transfer efficiency are improved, and the image density can be maintained easily. However, the adjustment of charge is difficult. For this reason, in a developing apparatus provided with a developing sleeve made of stainless steel having strong charge applying force, the toner existing in the vicinity of the surface of this sleeve has an extremely high charge. Under reflection force it is strongly attracted to the sleeve surface, resulting in an immobile layer. This decreases the chance that the toner is rubbed with the sleeve, thereby inhibiting charge application. As a result, due to nonuniform charge of the toner, a toner thin layer formed on the developing sleeve causes turbulence and lack of uniformity, which can lead to the image quality drop. Further, the toner shape tends to induce inferior cleaning.

In the present invention, as will be described later, the mean roundness is determined by finding a mean roundness of a particle group having a diameter corresponding to a circle of greater than 2 μm, by using a flow type particle image analyzer ("FPIA-1000 type," the product name of Sysmex Corp.).

The magnetic powder used in the invention is preferably in an octahedral shape. This suppresses the magnetic powder from releasing from the toner, so that the toner charge property can be stabilized to allow for even charge. As the magnetic powder has a more similar shape to a polyhedron exceeding an octahedron and further to a spherical body, the magnetic powder is more apt to release from the toner. If the magnetic powder releases frequently, its prolonged use can cause lack of uniformity in the way of chipping (wearing) the surface of a photosensitive material drum, thus leading to variations in the surface potential of the photosensitive material drum. Among others, when the photosensitive material drum is an amorphous silicon drum, it is often low-potential phenomenon. At the time of the reversal development of a digital latent image, in particular, its potential difference becomes smaller. This tends to cause lack of uniformity in image density. Further, image density is lowered due to a deficiency in the amount of charge of the magnetic toner, and the charge is not applied uniformly. This tends to cause turbulence in a thin layer. To form a magnetic powder in an octahedron shape, the magnetic powder may be manufactured in the following manner, for example. That is, at the time of neutralization mixing of a ferrous salt solution and an alkali solution, the amount of addition of the alkali solution to the ferrous salt solution is set in a predetermined range (1 to 2 equivalents). The number average particle size of the magnetic powder is 0.05 to 0.5 μm, preferably about 0.1 to 0.3 μm.

Moreover, this magnetic powder has at its surface a phosphorous element of 0.10 to 0.50% by weight. Lack of charge in the toner creates a tendency of image density to drop. In the present invention, however, by the presence of a predetermined amount of phosphorous element at the magnetic powder surface as above described, the charge in the toner can be stabilized to achieve excellent developing property, thereby obtaining excellent image density maintaining property. In addition, the charge can be applied uniformly, so that a thin layer is less susceptible to turbulence. When a phosphorous element is present in an amount of less than 0.10% by weight, the abundance of the phosphorous element is too small to sufficiently suppress the turbulence of the toner thin layer formed on the developing sleeve. When the abundance of the phosphorous element exceeds 0.50% by weight, the toner flowability and dispersibility will deteriorate, so that magnetic cohesion is apt to occur. As a result, the supply of the toner onto the sleeve becomes unstable (a drop in developing property), and image density is lowered. A still more abundance of phosphorous element makes it impossible to maintain the magnetic property of the magnetic powder. This results in a drop in saturation magnetization, so that fog is apt to occur. For example, the abundance of a phosphorous element to the above-mentioned range may be controlled by adjusting the amount of addition of a phosphorous element supply source, such as aqueous solution of sodium hexametaphosphate to be added to a reaction solution during oxidation reaction of ferrous hydroxide.

In the present invention, as will be described later, the abundance of a phosphorous element at the magnetic powder surface is determined in the following manner. A 0.900 g of a magnetic powder is weighed, and a 25-mL of 1N-NaOH solution is added thereto. The mixed solution is heated to 45° C. with agitation, and then held for 30 minutes so as to dissolve a phosphorous component at particle surfaces. After filtering non-dissolved material, an eluate was determined with pure water so as to be 125 mL. The phosphorous contained in the eluate is determined by plasma emission spectrometry (ICP), and calculated by using the following equation. In the plasma emission spectrometry, "SP4000 type," the product name of Seiko Denshi Kogyo Co., Ltd., was used.

$$\text{Abundance of phosphorous element at magnetic powder surface (\% by weight)}=[\{\text{Phosphorous contained in eluate (g/L)}\times 125\div 1000\}/0.900\text{ (g)}]\times 100$$

In the cases where instead of a phosphorous element, other element (Al, Mg) is present at the surface of a magnetic powder, a slight effect of suppressing turbulence in a thin layer is observed, though it is inferior to that of the phosphorous element. This is, however, not enough to sufficiently suppress the image density drop. Particularly in low-temperature low-humidity environment, the turbulence in a thin layer cannot be suppressed unless the phosphorous element in the above-mentioned range is allowed to present at the surface of the magnetic powder. In addition to a phosphorous element, other additive elements (Al, Mg, etc) may be present at the surface of the magnetic powder.

As the material of the magnetic powder, any material known in the art can be used. Specifically, metals or alloys exhibiting ferromagnetism, for example, irons such as ferrite and magnetite, cobalt, and nickel; compounds containing these elements; alloys that contain no element of ferromagnetism but can exhibit ferromagnetism by applying a suitable heat treatment; and chromium dioxide. It is possible to use the magnetic powder after being subjected to surface treatment with a surface treatment agent such as titanium coupling agent or silane coupling agent.

The magnetic powder is contained in the toner in an amount of 30 to 60% by weight, preferably 45 to 55% by weight. The volume average particle size of the toner particles is 6.0 to 9.0 μm, preferably 5 to 9 μm.

No special limitation is imposed on the material of a binding resin constituting the toner particles. However, it is preferable to use thermoplastic resins such as styrene resin, acrylic resin, styrene-acrylic copolymer, polyethylene resin, polypropylene resin, polyvinyl chloride, polyester resin, polyamide resin, polyurethane resin, polyvinyl alcohol resin, vinyl ether resin, N-vinyl resin, and styrene-butadiene resin. In consideration of low-temperature fixing property, it is especially more preferable to use polyester resin.

Specifically, it is possible to use any one of polyester resins obtainable through condensation polymerization or co-condensation polymerization of an alcohol component and a carboxylic acid component. Examples of components used in synthesizing polyester resin are as follows. As an example of an alcohol component of bivalent, trivalent or polyvalent, there are diols such as ethylene glycol, diethylene glycol, triethylene glycol, 1,2-propylen glycol, 1,3-propylene glycol, 1,4-butanediol, neopentyl glycol, 1,4-butenediol, 1,5-pentanediol, 1,6-hexanediol, 1-4-cyclohexanedimethanol, dipropylene glycol, polyethylene glycol, polypropylene glycol, and polytetramethylene glycol; bisphenols such as bisphenol A, hydrogenated bisphenol A, polyoxyethylene bisphenol A, and polyoxypropylene bisphenol A; and trivalent or polyvalent alcohols such as sorbitol, 1,2,3,6-hexanetetrol, 1,4-sorbitane, pentaerythritol, dipentaerythritol, tripentaerythritol, 1,24-butanetriol, 1,2,5-pentanetriol, glycerol, diglycerol, 2-methylpropanetriol; 2-methyl-1,2,4-butanetriol, trimethylolethane, trimethylolpropane, and 1,3,5-trihydroxymethylbenzene.

As a carboxylic acid component of bivalent, trivalent or polyvalent, bivalent or trivalent carboxylic acid, acid anhydride thereof or lower alkyl ester thereof can be used. There are, for example, bivalent carboxylic acids of alkyl or alkenylsuccinic acid, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, or n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecylsuccinic acid, n-dodecenylsuccinic acid, isododecylsuccinic acid, isododecenylsuccinic acid; and trivalent or polyvalent carboxylic acids such as 1,2,4-benzenetricarboxylic acid (trimellitic acid), 1,2,5-benzenecarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylcarboxyl)methane, 1,2,7,8-octanetetracarboxylic acid, pyromellitic acid, and enpole trimer acid. The softening point of polyester resin is preferably 80 to 150° C., more preferably 90 to 140° C.

The binding resin may be a thermoplastic resin. Such an introduction of a partial cross linking structure enables to further improve the toner storage stability, shape holding property and durability, without lowering fixing property. This eliminates the need to use a 100% of thermoplastic resin as a binding resin. That is, a cross linking agent may be added. Alternatively, a thermoplastic resin may be used partially.

As a thermoplastic resin, epoxy resin, cyanate resin, etc. can be used. Specifically, bisphenol A type epoxy resin, hydrogenated bisphenol A type epoxy resin, novolak type epoxy resin, polyalkyl ether type epoxy resin, circular aliphatic epoxy resin, and cyanate resin can be used alone or in combination of two or more types.

In the present invention, the glass transition point (Tg) of a binding resin is 50 to 65° C., preferably 50 to 60° C. When the glass transition point is lower than the above range, the obtained toners become fused each other in a developing apparatus, which can deteriorate storage stability. Additionally, because resin strength is low, there is a tendency to cause the toner to adhere to a photosensitive material. On the other hand, when the glass transition point is higher than the above range, the low-temperature fixing property of the toner can be lowered. The glass transition point of the binding resin can be found from a change point of specific heat by using a differential scanning calorimeter (DSC). Specifically, it can be determined by measuring an endothermic curve by using a differential scanning calorimeter "DSC-6200," manufactured by Seiko Instruments Co., Ltd., as measurement equipment. In this case, a 10 mg of test portion is put in an aluminum pan, and an empty aluminum pan is used as reference. In ordinary temperature and ordinary humidity, a measurement is made at a measuring temperature range of 25 to 200° C., and a temperature raising speed of 10° C./min, thereby obtaining an endothermic curve, from which a glass transition point is found.

In the toner of the invention, as in the case with known ones, a pigment such as a carbon black, and a dye such as acid violet can be dispersed as a coloring agent in a binding resin, in order to adjust color tone. Such a coloring agent is usually blended in an amount of 1 to 10 mass parts to 100 mass parts of the above binding resin.

A charge control agent is blended in order to significantly improve charge level and charge rise property (an index indicating whether it is possible to charge to a certain charge level in a short time), and obtain characteristics excellent in durability and stability. In other words, a charge control agent of positive charging property is added when the toner is positively charged for development, and a charge control agent of negative charging property is added when the toner is negatively charged for development.

No special limitation is imposed on such a charge control agent. As example of the charge control agent of positive charging property, there are azine compounds such as pyridazine, pyrimidine, pyrazine, orthooxazine, metaoxazine, paraoxazine, orthothiazine, metathiazine, parathiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3, 5-tetrazine, 1,2,4,6-oxatriazine, 1,3,4,5-oxatriazine, phthalazine, quinazoline, and quinoxaline; direct dyes composed of an azine compound, such as azine first red FC, azine first red 12BK, azine violet BO, azine brown 3G, azine light brown GR, azine dark green BH/C, azine deep black EW, and azine deep black 3RL; nigrosine compounds such as nigrosine, nigrosine salt, and nigrosine derivative; acid dyes composed of a nigrosine compound, such as nigrosine BK, nigrosine NB, and nigrosine Z; metallic salts of naphthenic acid or higher fatty acid; alkoxylate amine; alkylamide; and quaternary ammonium salts such as benzylmethylhexyldecyl ammonium, and decyltrimethyl ammonium chloride. These may be used solely. Alternatively, two or more of these may be used simultaneously. In particular, nigrosine compound is the most suitable for use as a positive charging property toner, because a speedier rise property is achievable.

It is also possible to use, as a charge control agent of positive charging property, quaternary ammonium salt, carboxylate, and resin or oligomer having a carboxyl group as a functional group. Specifically, there are styrene resin having quaternary ammonium salt, acrylic resin having quaternary ammonium salt, styrene-acrylic resin having quaternary ammonium salt, polyester resin having quaternary ammonium salt, styrene resin having carboxylate, acrylic resin having carboxylate, styrene-acrylic resin having carboxylate, polyester resin having carboxylate, polystyrene resin having carboxyl group, acrylic resin having carboxyl group, styrene-acrylic resin having carboxyl group, and polyester resin having carboxyl group. These may be used solely. Alternatively, two or more kinds of these may be used simultaneously.

In particular, styrene-acrylic copolymerized resin having quaternary ammonium salt as a functional group is the most suitable because it is easy to adjust the amount of charge to a value in the desired range. In this case, an example of preferable acrylic monomer to be copolymerized with the above-mentioned styrene unit is alkyl ester of (meth)acrylic acid such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate. As quaternary ammonium salt, there can be used such a unit that is induced through the step of bringing dialkylaminoalkyl (meth)acrylate into quaternary one. Examples of suitable dialkylaminoalkyl(meth)acrylate are di(lower-alkyl)aminoethyl (meth)acrylate such as dimethylaminoethyl (meth)acrylate, diethylaminoethyl(meth)acrylate, dipropylaminoethyl (meth)acrylate, and dibutylaminoethyl (meth)acrylate; dimethyl methacrylamide, and dimethylaminopropyl methacrylamide. Further, polymerized monomer containing hydroxy group, such as hydroxyethyl (meth)acrylate, hydroxypropyl (meth)acrylate, 2-hydroxybuthyl (meth)acrylate, or N-methylol (meth)acrylamide, can be used simultaneously at the time of polymerization.

As a charge control agent of negative charging property, organic metallic complex, chelated compound, etc. are effective. For example, there are aluminum acetyl acetonate, iron (II) acetyl acetonate, and 3,5-di-tert-butyl salicylate chrome. In particular, acetylacetone metallic complex, and salicylic acid metallic complex or salt are preferable. Among others, salicylic acid metal complex or salicylic acid metallic salt is especially preferable.

The above-mentioned charge control agent of positive or negative charging property is contained in the toner in an amount of 1.5 to 15 mass parts, preferably 2.0 to 8.0 mass parts, more preferably 3.0 to 7.0 mass parts (provided that the entire amount of the toner is 100 mass parts). When the charge control agent content is less than the above range, there is a tendency to have difficulties in stably charging the toner to a predetermined polarity. If this toner is used to develop an electrostatic latent image so as to form an image, there is a tendency to lower image density and deteriorate the durability of the image density. Further, the charge control agent is susceptible to poor dispersion. This can cause so-called fog, and create a tendency to strengthen the contamination of photosensitive material. On the other hand, when the charge control agent content exceeds the above range, there is a tendency to have drawbacks in environment resistance, such as poor charge and poor image especially in high-temperature high-humidity, so that the contamination of photosensitive material is apt to occur.

No special limitation is imposed on waxes used for improving fixing property and offset-proof property. It is however preferable to use, for example, polyethylene wax, polypropylene wax, fluoroethylene resin (e.g., "Teflon" manufactured by DuPont Corp.) wax, Fischer-Tropsch wax, paraffin wax, ester wax, montan wax, and rice wax. Two or more kinds of these may be used simultaneously. The addition of such a wax permits a more efficient prevention of offset property and image smearing.

No special limitation is imposed on the amount of addition of the above waxes. It is however preferable to add 1 to 5 mass parts (provided that the total amount of the toner is 100 mass parts). When the wax content is less than 1 mass part, there is such a tendency that the offset property and image smearing cannot be prevented efficiently. On the other hand, when it exceeds 5 mass parts, there is such a tendency that the toners become fused each other, and storage stability is lowered.

To the magnetic one-component toner of the invention, fine grains (external additive agent) such as colloidal silica, hydrophobic silica, alumina, and titanium oxide may be added externally, as needed. An external additive agent is preferably added in an amount of approximately 0.2 to 10 mass parts to 100 mass parts of the toner particles. Furthermore, the volume average particle size of the external additive agent is not more than 1 μm, preferably 0.02 to 0.8 μm. The external addition of the above external additive agent to the above toner particles enables to control the flowability, storage stability and cleaning property of the toner. As a stirring and mixing apparatus for externally adding the above external additive agent to the toner particles, any apparatus capable of stirring and mixing toner particles and an external additive agent in dry process may be used. To prevent the external additive agent from being buried in the toner particles, it is preferable to use a Henschel mixer or a Nauter mixer.

No special limitation is imposed on the binding resin, magnetic material, dye, pigment, and charge control agent in the magnetic one-component toner of the invention. It is possible to suitably select and use any known material.

The forgoing magnetic one-component toner is especially suitable for use in an image forming apparatus provided with a developing sleeve made of stainless steel as a developer carrier, and an amorphous silicon photosensitive material.

In other words, although aluminum-made developing sleeves were used thus far, it has been found that when an aluminum-made developing sleeve is used in an attempt to allow a developing apparatus to have the same durability as a developing sleeve, and moreover achieve a still higher speed, the durability thereof is unsatisfactory in practice. For this reason, a developing sleeve made of stainless steel having a higher hardness has been used, but there is a drawback in terms of charge applying property to a toner. In some case, it fails to obtain excellent image. In contrast, the use of the toner of the invention provides excellent image even if a developing sleeve made of stainless steel is used.

Examples of the above stainless steel (SUS) are SUS303, SUS304, SUS305, and SUS316. In particular, it is preferable to use SUS305 that has weak magnetism and can be machined easily.

Insofar as the above photosensitive material is amorphous silicon (a-Si) series, no special limitation is imposed thereon. For example, there are inorganic materials such as a-Si, a-SiC, a-SiO, and a-SiON. Among these, a-Si has a high resistance and is especially suitable for achieving higher charging capability, friction resistance, and environment resistance. When using a-SiC, it is preferable to use one in which the rate of Si to C (carbon) falls in a predetermined range. As example of such a-SiC, there is a-$Si_{1-X}C_X$ (the value of X is from 0.3 to less than 1.0), preferably a-$Si_{1-X}C_X$ (the value of X is from 0.5 to less than 0.95). An a-SiC, in which the rate of Si to C falls into the above range, has particularly a high resistance, namely $10^{12}$ to $10^{13}$ Ωcm, and has less flow of latent image charge in the direction of a photosensitive material on the surface of the photosensitive material. Such an a-SiC also has excellent capability of maintaining an electrostatic latent image and excellent moisture resistance.

The magnetic one-component toner of the present invention will be described in detail through the following examples and comparative examples. It is understood, however, that the examples are for the purpose of illustration and the invention is not to be regarded as limited to any of the specific materials or condition therein.

EXAMPLES

Example I

<Manufacture of Magnetic Powder>

(Magnetic Powder 1)

A 60-liter of ferrous sulfate aqueous solution of 1.8 mol/l, and 45-liter of sodium hydroxide of 5 mol/l were sufficiently stirred and mixed to prepare a ferrous hydroxide slurry. While maintaining this slurry at 80 to 90° C., air was blown therein at 20-liter/min., to initiate oxidation reaction. At the point of time that the oxidation reaction reached 50% of the entire $Fe^{2+}$, 10-liter of aqueous solution of sodium hexametaphosphate of 0.1 mol/l was added in 60 minutes to the ferrous hydroxide slurry containing magnetite in the ongoing oxidation reaction, so as to maintain a PH value of 6 to 9, and the oxidation reaction was terminated. The slurry of magnetic particles after the reaction was washed, filtered and dried by a conventional method. Subsequently, slightly aggregated particles were disaggregated to obtain a magnetic powder 1 having physical properties as indicated in Table 1.

(Magnetic Powder 2)

A magnetic powder 2 having physical properties as indicated in Table 1 was obtained in the same manner as in the magnetic powder 1, except that the amount of addition of the aqueous solution of sodium hexametaphosphate was changed to 1.8-liter.

(Magnetic Powder 3)

A magnetic powder 3 having physical properties as indicated in Table 1 was obtained in the same manner as in the magnetic powder 1, except that the amount of addition of the aqueous solution of sodium hexametaphosphate was changed to 12.5-liter.

(Magnetic Powder 4)

A magnetic powder 4 having physical properties as indicated in Table 1 was obtained in the same manner as in the magnetic powder 1, except that the amount of addition of the aqueous solution of sodium hexametaphosphate was changed to 1.5-liter.

(Magnetic Powder 5)

A magnetic powder 5 having physical properties as indicated in Table 1 was obtained in the same manner as in the magnetic powder 1, except that the amount of addition of the aqueous solution of sodium hexametaphosphate was changed to 13-liter.

(Magnetic Powder 6)

A 60-liter of ferrous sulfate aqueous solution of 1.8 mol/l and 45-liter of sodium hydroxide aqueous solution of 5 mol/l were sufficiently stirred and mixed to prepare a ferrous hydroxide slurry. While maintaining this slurry at 80 to 90° C., air was blown therein at 100-liter/min for 220 minutes to maintain a PH value of 6 to 9. In this state, oxidation reaction was carried out to generate magnetic particle. The slurry of the magnetic particles after the reaction was washed, filtered and dried by a conventional method. Subsequently, slightly aggregated particles were disaggregated to obtain a magnetic powder 6 having physical properties as indicated in Table 1.

TABLE 1

| Magnetic Powder | Shape | Number Average Particle Size (μm) | Amount of P Element on Magnetic Powder Surface (wt %) |
|---|---|---|---|
| 1 | Octahedron | 0.21 | 0.35 |
| 2 | Octahedron | 0.20 | 0.10 |
| 3 | Octahedron | 0.20 | 0.50 |
| 4 | Octahedron | 0.20 | 0.07 |
| 5 | Octahedron | 0.20 | 0.54 |
| 6 | Octahedron | 0.20 | 0 |

The shape, number average particle size of the above magnetic powder, and the abundance of phosphorous element on the magnetic powder surface were determined as follows.

(Shape of Magnetic Powder)

The shape of particles was observed by a scanning electron microscope at a magnification of ×20,000.

(Number Average Particle Size)

The shape of particles was observed by a scanning electron microscope at a magnification of ×20,000. Then, 200 particles were measured in terms of fere diameter, and its number average particle diameter was found.

(The amount of Phosphorous Element on Magnetic Powder Surface)

A 0.900 g of magnetic powder was weighed, and 25-mL of 1N-NaOH solution was added thereto. This solution was heated to 45° C. with stirring, and held for 30 minutes so as to dissolve the phosphorous component on the particle surface. After filtering non-dissolved material, an eluate was determined with pure water so as to be 125-mL. The phosphorous contained in the eluate was determined by plasma emission spectrometry (ICP). In the plasma emission spectrometry method, "SP4000 type," the product name of Seiko Denshi Kogyo Co., Ltd., was used. The formula of the amount of phosphorous element is as follows:

Amount of phosphorous element at magnetic powder surface (% by weight)=[{Phosphorous contained in eluate (g/L)×125÷1000}/0.900 (g)]×100

<Manufacture of Binding Resin>

(Resin A)

The following materials were reacted in a nitrogen atmosphere at 220° C. for 8 hours, and the reaction was continued until it reached 155° C. under reduced pressure, thereby obtaining a polyester resin A.

| | |
|---|---|
| Bisphenol A with 2.2 mol of propylene oxide | 2000 g |
| Bisphenol A with 2.2 mol of ethylene oxide | 800 g |
| Terephthalic acid | 500 g |
| N-dodecenyl succinic acid | 600 g |
| Trimellitic acid anhydride | 350 g |
| Tin dibutyl oxide | 4 g |

(Resin B)

The following materials were reacted in a nitrogen atmosphere at 220° C. for 8 hours, and the reaction was continued until it reached 90° C. under reduced pressure, thereby obtaining a polyester resin B.

| | |
|---|---|
| Bisphenol A with 2.2 mol of propylene oxide | 2800 g |
| Terephthalic acid | 400 g |
| Fumaric acid | 650 g |
| Tin dibutyl oxide | 4 g |

<Manufacture of Magnetic One-Component Toner>

(Toner A)

The following materials were premixed by a Henschel mixer, and then melted and kneaded by using a biaxial extruder. After cooling this melt-kneaded material, this was ground to 11.0 μm in volume average particle size by a mechanical grinder ("Cryptron," the product name of Kawasaki Heavy Industries Limited.). This ground material was further ground to 7.2 μm in volume average particle size by this grinder. Then, a fine powder and a rough powder were classified at the same time by a gas stream classifier, resulting in a toner particle having a volume average particle size of 7.6 μm and a mean roundness of 0.956. To 100 mass parts of this toner particle, 0.8 mass parts of hydrophobic silica ("TG820F," the product name of Cabot Corp.) was added externally and then mixed by the Henschel mixer, resulting in a toner A having physical properties as indicated in Table 2. Styrene acrylic quaternary ammonium salt ("FCA222P," the product name of Fujikura Kasei Co., Ltd.) was used as a charge control agent, and "Karunaba Wax #1," the product name of Katoyoko Co., Ltd., was used as a wax.

Binding Resin:

| | |
|---|---|
| (50 mass parts of Resin A and 50 mass parts of Resin B) | 100 mass parts |
| Magnetic powder 1 | 80 mass parts |
| Charge control agent | 10 mass parts |
| Wax | 5 mass parts |

(Toner B)

A melt-kneaded material was obtained in the same manner as in the toner A. After cooling this melt-kneaded material, this was ground to 10.5 μm in volume average particle size by the above grinder. This ground material was further ground to 6.3 μm in volume average particle size by this grinder. Then, a fine powder and a rough powder were classified at the same time by a gas stream classifier, resulting in a toner particle having a volume average particle size of 6.8 μm and a mean roundness of 0.958. Thereafter, the same processing as in the toner A was done to obtain a toner B having physical properties as indicated in Table 2.

(Toner C)

A melt-kneaded material was obtained in the same manner as in the toner A. After cooling this melt-kneaded material, this was ground to 11.5 μm in volume average particle size by the above grinder. This ground material was further ground to 7.6 μm in volume average particle size by this grinder. Then, a fine powder and a rough powder were classified at the same time by a gas stream classifier, resulting in a toner particle having a volume average particle size of 8.2 μm and a mean roundness of 0.951. Thereafter, the same processing as in the toner A was done to obtain a toner C having physical properties as indicated in Table 2.

(Toner D)

A melt-kneaded material was obtained in the same manner as in the toner A. After cooling this melt-kneaded material, this was ground to 12.0 μm in volume average particle size by the above grinder. This ground material was further ground to 8.4 μm in volume average particle size by this grinder. Then, a fine powder and a rough powder were classified at the same time by a gas stream classifier, resulting in a toner particle having a volume average particle size of 8.8 μm and a mean roundness of 0.953. Thereafter, the same processing as in the toner A was done to obtain a toner D having physical properties as indicated in Table 2.

(Toner E)

A melt-kneaded material was obtained in the same manner as in the toner A. After cooling this melt-kneaded material, this was ground to 11.0 μm in volume average particle size by the above grinder. This ground material was further ground to 8.6 μm in volume average particle size by this grinder. Again this ground material was ground to 5.7 μm in volume average particle size by this grinder. Then, a fine powder and a rough powder were classified at the same time by a gas stream classifier, resulting in a toner particle having a volume average particle size of 6.2 μm and a mean roundness of 0.960. Thereafter, the same processing as in the toner A was done to obtain a toner E having physical properties as indicated in Table 2.

(Toner F)

A melt-kneaded material was obtained in the same manner as in the toner A, except that the magnetic powder 1 was replaced with the magnetic powder 2. After cooling this melt-kneaded material, this was ground to 10.5 μm in volume average particle size by the above grinder. This ground material was further ground to 7.3 μm in volume average particle size by this grinder. Then, a fine powder and a rough powder were classified at the same time by a gas stream classifier, resulting in a toner particle having a volume average particle size of 7.8 μm and a mean roundness of 0.958. Thereafter, the same processing as in the toner A was done to obtain a toner F having physical properties as indicated in Table 2.

(Toner G)

A melt-kneaded material was obtained in the same manner as in the toner F. After cooling this melt-kneaded material, this was ground to 10.5 μm in volume average particle size by the above grinder. This ground material was further ground to 8.3 μm in volume average particle size by this grinder. Then, a fine powder and a rough powder were classified at the same time by a gas stream classifier, resulting in a toner particle having a volume average particle size of 8.6 μm and a mean roundness of 0.956. Thereafter, the same processing as in the toner A was done to obtain a toner G having physical properties as indicated in Table 2.

(Toner H)

A melt-kneaded material was obtained in the same manner as in the toner A, except that the magnetic powder 1 was replaced with the magnetic powder 1. After cooling this melt-kneaded material, this was ground to 11.0 μm in volume average particle size by the above grinder. This ground material was further ground to 7.3 μm in volume average particle size by this grinder. Then, a fine powder and a rough powder were classified at the same time by a gas stream classifier, resulting in a toner particle having a volume average particle size of 7.6 μm and a mean roundness of 0.957. Thereafter, the same processing as in the toner A was done to obtain a toner H having physical properties as indicated in Table 2.

(Toner I)

A melt-kneaded material was obtained in the same manner as in the toner H. After cooling this melt-kneaded material, this was ground to 10.5 μm in volume average particle size by the above grinder. This ground material was further ground to 8.1 μm in volume average particle size by this grinder. Then, a fine powder and a rough powder were classified at the same time by a gas stream classifier, resulting in a toner particle having a volume average particle size of 8.5 μm and a mean roundness of 0.955. Thereafter, the same processing as in the toner A was done to obtain a toner I having physical properties as indicated in Table 2.

(Toner J)

A melt-kneaded material was obtained in the same manner as in the toner A. After cooling this melt-kneaded material, this was ground to 11.0 μm in volume average particle size by the above grinder. This ground material was further ground to 8.6 μm in volume average particle size by this grinder. Again this ground material was ground to 7.1 μm in volume average particle size by this grinder. Then, a fine powder and a rough powder were classified at the same time by a gas stream classifier, resulting in a toner particle having a volume average particle size of 7.5 μm and a mean roundness of 0.966. Thereafter, the same processing as in the toner A was done to obtain a toner J having physical properties as indicated in Table 2.

(Toner K)

A melt-kneaded material was obtained in the same manner as in the toner A. After cooling this melt-kneaded material, this was ground to 11.0 μm in volume average particle size by the above grinder. This ground material was further ground to 8.0 μm in volume average particle size by this grinder. Again this ground material was ground to 5.1 μm in volume average particle size by this grinder. Then, a fine powder and a rough powder were classified at the same time by a gas stream classifier, resulting in a toner particle having a volume average particle size of 5.5 μm and a mean roundness of 0.963. Thereafter, the same processing as in the toner A was done to obtain a toner K having physical properties as indicated in Table 2.

(Toner L)

A melt-kneaded material was obtained in the same manner as in the toner A. After cooling this melt-kneaded material, this was ground to 12.0 μm in volume average particle size by the above grinder. This ground material was further ground to 8.5 μm in volume average particle size by this grinder. Then, a fine powder and a rough powder were classified at the same time by a gas stream classifier, resulting in a toner particle having a volume average particle size of 9.2 μm and a mean roundness of 0.951. Thereafter, the same processing as in the toner A was done to obtain a toner L having physical properties as indicated in Table 2.

(Toner M)

A melt-kneaded material was obtained in the same manner as in the toner A. After cooling this melt-kneaded material, this was ground to 6.8 μm in volume average particle size by the above grinder. Then, a fine powder and a rough powder were classified at the same time by a gas stream classifier, resulting in a toner particle having a volume average particle size of 7.2 μm and a mean roundness of 0.935. Thereafter, the same processing as in the toner A was done to obtain a toner M having physical properties as indicated in Table 2.

(Toner N)

A melt-kneaded material was obtained in the same manner as in the toner A. After cooling this melt-kneaded material, this was ground to 11.0 μm in volume average particle size by the above grinder. This ground material was further ground to 6.9 μm in volume average particle size by this grinder. Then, a fine powder and a rough powder were classified at the same time by a gas stream classifier, resulting in a toner particle having a volume average particle size of 7.2 μm and a mean roundness of 0.956. Thereafter, the same processing as in the toner A was done to obtain a toner N having physical properties as indicated in Table 2.

(Toner O)

A melt-kneaded material was obtained in the same manner as in the toner A. After cooling this melt-kneaded material, this was ground to 11.0 μm in volume average particle size by the above grinder. This ground material was further ground to 7.0 μm in volume average particle size by this grinder. Then, a fine powder and a rough powder were classified at the same time by a gas stream classifier, resulting in a toner particle having a volume average particle size of 7.6 μm and a mean roundness of 0.956. Thereafter, the same processing as in the toner A was done to obtain a toner O having physical properties as indicated in Table 2.

(Toner P)

A melt-kneaded material was obtained in the same manner as in the toner A, except that the magnetic powder 1 was replaced with the magnetic powder 4. After cooling this melt-kneaded material, this was ground to 10.5 μm in volume average particle size by the above grinder. This ground material was further ground to 7.2 μm in volume average particle size by this grinder. Then, a fine powder and a rough powder were classified at the same time by a gas stream classifier, resulting in a toner particle having a volume average particle size of 7.5 μm and a mean roundness of 0.957. Thereafter, the same processing as in the toner A was done to obtain a toner P having physical properties as indicated in Table 2.

(Toner Q)

A melt-kneaded material was obtained in the same manner as in the toner P. After cooling this melt-kneaded material, this was ground to 11.5 μm in volume average particle size by the above grinder. This ground material was further ground to 8.1 μm in volume average particle size by this grinder. Then, a fine powder and a rough powder were classified at the same time by a gas stream classifier, resulting in a toner particle having a volume average particle size of 8.8 μm and a mean roundness of 0.955. Thereafter, the same processing as in the toner A was done to obtain a toner Q having physical properties as indicated in Table 2.

(Toner R)

A melt-kneaded material was obtained in the same manner as in the toner A, except that the magnetic powder 1 was replaced with the magnetic powder 5. After cooling this melt-kneaded material, this was ground to 11.0 μm in volume average particle size by the above grinder. This ground material was further ground to 7.3 μm in volume average particle size by this grinder. Then, a fine powder and a rough powder were classified at the same time by a gas stream classifier, resulting in a toner particle having a volume average particle size of 7.6 μm and a mean roundness of 0.956. Thereafter, the same processing as in the toner A was done to obtain a toner R having physical properties as indicated in Table 2.

(Toner S)

A melt-kneaded material was obtained in the same manner as in the toner R. After cooling this melt-kneaded material, this was ground to 11.0 μm in volume average particle size by the above grinder. This ground material was further ground to 6.6 μm in volume average particle size by this grinder. Then, a fine powder and a rough powder were classified at the same time by a gas stream classifier, resulting in a toner particle having a volume average particle size of 7.2 μm and a mean roundness of 0.954. Thereafter, the same processing as in the toner A was done to obtain a toner S having physical properties as indicated in Table 2.

(Toner T)

A melt-kneaded material was obtained in the same manner as in the toner A, except that the magnetic powder 1 was replaced with the magnetic powder 6. After cooling this melt-kneaded material, this was ground to 12.0 μm in volume average particle size by the above grinder. This ground material was further ground to 7.9 μm in volume average particle size by this grinder. Then, a fine powder and a rough powder were classified at the same time by a gas stream classifier, resulting in a toner particle having a volume average particle size of 8.4 μm and a mean roundness of 0.958. Thereafter, the same processing as in the toner A was done to obtain a toner T having physical properties as indicated in Table 2.

(Toner U)

A melt-kneaded material was obtained in the same manner as in the toner T. After cooling this melt-kneaded material, this was ground to 10.5 μm in volume average particle size by the above grinder. This ground material was further ground to 6.0 μm in volume average particle size by this grinder. Then, a fine powder and a rough powder were classified at the same time by a gas stream classifier, resulting in a toner particle having a volume average particle size of 6.5 μm and a mean roundness of 0.955. Thereafter, the same processing as in the toner A was done to obtain a toner U having physical properties as indicated in Table 2.

The volume average particle size, compressibility, and mean roundness of the toner were determined as follows.

(Volume Average Particle Size of Toner)

An interface and a personal computer for outputting a volume average distribution were connected to "Coulter-Counter TA-II type," the product name of Coulter Corp. Using sodium chloride of first class grade chemical as electrolyte, a 1% sodium chloride aqueous solution was prepared. To 100 to 150 ml of this electrolyte, 0.1 to 5 ml of a surface active agent ("Mypet," the product name of Kao Co., Ltd., alkyl benzene sodium sulfonate) was added as a dispersing agent, and further 0.5 to 50 mg of the toner as a test portion was added and suspended. This electrolyte so suspended was dispersed for about 1 to 3 minutes by an ultrasonic dispersing apparatus. By the above Call-Counter TA-II type, the particle size distribution of toner particles from 2 to 40 μm was measured with the use of an aperture of 100 μm, and the volume distribution of the toner was found. The volume average particle size of the toner was found from this volume distribution.

(Compressibility of Toner)

Using "Powder Tester," the product name of Hosokawa Micron Co., Ltd, the following measurements were made.

(A) The toner was vibrated to drop naturally and allowed to fill a cylindrical container. In this state, a slack apparent specific gravity A was found.

(B) Subsequently, the toner was allowed to drop in the same manner as above (A), while tapping the cylindrical container in above (A), so as to increase filling factor. Then, a solid apparent specific gravity was found.

(C) Compressibility was calculated by applying the obtained slack apparent specific gravity A and the solid apparent specific gravity P to the following equation:

$$\text{Compressibility (\%)}=[\{P-A\}/P]\times 100$$

(Means Roundness of Toner)

A 10-ml of ion-exchange water with impurities removed was put in a container. To this ion-exchange water, 0.1 to 5 ml of a surface active agent (alkyl benzene sodium sulfonate) was added as a dispersing agent, and further 0.02 g of a test portion was added and then dispersed for 2 minutes by using an ultrasonic dispersing apparatus, thereby preparing a uniformly dispersed measuring dispersed liquid. During the dispersion, the dispersed liquid was cooled properly so as not to be 40° C. or higher. This dispersed liquid was measured by a flow type particle image measuring apparatus ("FPIA-1000 type," the product name of Sysmex Corp.).

In the above measurement, the dispersed liquid density was readjusted such that the toner particle density at the time of measurement was 3,000 to 10,000/μl. Thereafter, not less than 1,000 toner particles were measured to obtain data. From this data, the data of the toner particles of not more than 2 μm was deleted. To calculate a roundness (c), the resulting data was applied to the following equation:

$$\text{Roundness } (c)=\text{Circumference length of circle of the same area as particle projected area/Circumference length of particle projected image}$$

wherein "particle projected area" indicates a binarized toner particle image area, and "circumference length of particle projected image" indicates the length of a contour line obtained by connecting the edge points of the toner particle image.

Next, to calculate a mean roundness, the obtained roundness (c) was applied to the following equation:

$$\text{Mean Roundness}=(\text{Sum of } (c) \text{ values for measured toner particle number 1 to } m)/m$$

wherein m indicates the number of the measured toner particles.

In the present invention, the roundness is an index indicating the degree of irregularities of the toner particles. This indicates 1.0000 when the toner particle is a perfect spherical. The roundness has a smaller value, as the surface shape is more complicated.

TABLE 2

| Toner | Magnetic Powder | Volume Average Particle Size (μm) | Compressibility (%) | Means Roundness |
|---|---|---|---|---|
| A | 1 | 7.6 | 32 | 0.956 |
| B | 1 | 6.8 | 37 | 0.958 |
| C | 1 | 8.2 | 26 | 0.951 |
| D | 1 | 8.8 | 17 | 0.953 |
| E | 1 | 6.2 | 48 | 0.960 |
| F | 2 | 7.8 | 38 | 0.958 |
| G | 2 | 8.6 | 40 | 0.956 |
| H | 3 | 7.6 | 45 | 0.957 |
| I | 3 | 8.5 | 37 | 0.955 |
| J | 1 | 7.5 | 28 | 0.966 |
| K | 1 | 5.5 | 45 | 0.963 |
| L | 1 | 9.2 | 21 | 0.951 |
| M | 1 | 7.2 | 35 | 0.935 |
| N | 1 | 7.2 | 52 | 0.956 |
| O | 1 | 7.6 | 12 | 0.956 |
| P | 4 | 7.5 | 40 | 0.957 |
| Q | 4 | 8.8 | 20 | 0.955 |
| R | 5 | 7.6 | 48 | 0.956 |
| S | 5 | 7.2 | 25 | 0.954 |
| T | 6 | 8.4 | 33 | 0.958 |
| U | 6 | 6.5 | 43 | 0.955 |

<Evaluations>

Evaluations in terms of image density, fog, image quality, and transfer efficiency at a temperature of 23° C. and a humidity of 50% were made at the initial stage (before printing) and immediately after 100,000 printing of a predetermined image evaluation pattern (a A-4 size manuscript having a printing rate of 6%) on printing papers by using an electrophotographic printer (a modified model of "LS-9500DN," the product name of Kyocera Mita Co., Ltd., mounting an a-Si photosensitive material drum and a developer carrier made of stainless steel (SUS305), and setting the circumferential speed of a developing sleeve to 370 mm/sec.). The evaluations were made in the following manners. The results of the evaluations are presented in Table 3, in which the symbol * indicates that an printing test was stopped due to remarkable turbulence and lack of uniformity of a thin layer over the entire surface of the developing sleeve.

(Image Density)

The density of a black solid portion in a printer image was measured by using a reflection density measuring apparatus ("TC-6D," the product name of Tokyo Denshoku Co., Ltd.). In Table 3, the symbols ○, Δ, and X indicate the following numerical ranges:

○: Image density of not less than 1.3

Δ: Image density of not less than 1.2 to less than 1.3

X: Image density of less than 1.2

(Fog)

The density of a non-image formed portion in the printer image, and the density of a base paper were measured by using the above reflection density measuring apparatus. Then, a difference in density between the two, [(Density of non-image formed portion)−(Density of base paper)], was calculated. In Table 3, the symbols ○ and X indicate the following numerical ranges:

○: Image density difference of less than 0.008

X: Image density difference of not less than 0.008

(Image Quality)

Visual observation of the image quality at the initial stage and that after 100,000 printing were made according to the following evaluation criteria:

◎: Clear image free of scattering, even through a magnifying lens

○: Clear image as viewed by the eye

Δ: No practical problem, despite a slight scattering

X: Besides scattering, remarkable characters missing (Transfer Efficiency)

The amount of toner consumption was found from the following equation. Since a plurality of toner containers were used, the sum of decrements of weight was found.

Amount of toner consumption=
(Sum of decrements of weight of after-printing toner containers with respect to initial stage Plus Variation in weight of developing apparatus)/Number of printed papers(100,000 pieces)

Next, the amount of toner recovery was found from the following equation. Since a plurality of transfer-remaining toner recovery tanks were used so as to correspond to the above toner containers, the sum of increments of weight was found.

Amount of toner recovery=
Sum of increments of weight of remaining/not transferring-toner recovery tank in after-printing with respect to initial stage/Number of printed papers(100,000 pieces)

The transfer efficiency was calculated by applying the amount of toner consumption and the amount of toner recovery so obtained to the following equation:

Transfer efficiency (%)=[{Amount of toner consumption Minus Amount of toner recovery}/Amount of toner consumption]×100

The obtained transfer efficiency was evaluated according to the following evaluation criteria:

○: Not less than 90%

Δ: 80 to 89%

X: Not more than 79%

TABLE 3

| | Magnetic | | Initial Stage | | | | After 100,000 Printing | | | | Image Quality | | Transfer Efficiency | |
|---|---|---|---|---|---|---|---|---|---|---|---|---|---|---|
| | Powder | Toner | Image Density | | Fog | | Image Density | | Fog | | Initial Stage | After 100,000 Printing | (%) | Evaluation |
| Example 1 | 1 | A | 1.413 | ○ | 0.003 | ○ | 1.356 | ○ | 0.002 | ○ | ◎ | ◎ | 94 | ○ |
| Example 2 | 1 | B | 1.381 | ○ | 0.005 | ○ | 1.337 | ○ | 0.004 | ○ | ◎ | ◎ | 91 | ○ |

TABLE 3-continued

| | Magnetic | | Initial Stage | | | | After 100,000 Printing | | | | Image Quality | | Transfer Efficiency | |
|---|---|---|---|---|---|---|---|---|---|---|---|---|---|---|
| | Powder | Toner | Image Density | | Fog | | Image Density | | Fog | | Initial Stage | After 100,000 Printing | (%) | Evaluation |
| Example 3 | 1 | C | 1.356 | ○ | 0.004 | ○ | 1.311 | ○ | 0.006 | ○ | ○ | ○ | 87 | Δ |
| Example 4 | 1 | D | 1.350 | ○ | 0.003 | ○ | 1.285 | Δ | 0.006 | ○ | ○ | Δ | 84 | Δ |
| Example 5 | 1 | E | 1.332 | ○ | 0.004 | ○ | 1.264 | Δ | 0.006 | ○ | ○ | Δ | 85 | Δ |
| Example 6 | 2 | F | 1.341 | ○ | 0.003 | ○ | 1.218 | Δ | 0.005 | ○ | ○ | Δ | 83 | Δ |
| Example 7 | 2 | G | 1.322 | ○ | 0.003 | ○ | 1.225 | Δ | 0.004 | ○ | ○ | Δ | 87 | Δ |
| Example 8 | 3 | H | 1.328 | ○ | 0.005 | ○ | 1.235 | Δ | 0.007 | ○ | ○ | Δ | 82 | Δ |
| Example 9 | 3 | I | 1.303 | ○ | 0.004 | ○ | 1.217 | Δ | 0.004 | ○ | ○ | Δ | 86 | Δ |
| Comparative Example 1 | 1 | J | * | * | * | * | * | * | * | * | X | X | * | * |
| Comparative Example 2 | 1 | K | 1.322 | ○ | 0.007 | ○ | 0.995 | X | 0.009 | X | ○ | X | 80 | Δ |
| Comparative Example 3 | 1 | L | 1.265 | ○ | 0.003 | ○ | 1.079 | X | 0.005 | ○ | X | X | 78 | X |
| Comparative Example 4 | 1 | M | 1.288 | ○ | 0.003 | ○ | 0.981 | X | 0.005 | ○ | Δ | X | 75 | X |
| Comparative Example 5 | 1 | N | 1.361 | ○ | 0.005 | ○ | 1.152 | X | 0.008 | X | ○ | X | 82 | Δ |
| Comparative Example 6 | 1 | O | * | * | * | * | * | * | * | * | X | X | * | * |
| Comparative Example 7 | 4 | P | * | * | * | * | * | * | * | * | X | X | * | * |
| Comparative Example 8 | 4 | Q | * | * | * | * | * | * | * | * | X | X | * | * |
| Comparative Example 9 | 5 | R | * | * | * | * | * | * | * | * | X | X | * | * |
| Comparative Example 10 | 5 | S | * | * | * | * | * | * | * | * | X | X | * | * |
| Comparative Example 11 | 6 | T | * | * | * | * | * | * | * | * | X | X | * | * |
| Comparative Example 12 | 6 | U | * | * | * | * | * | * | * | * | X | X | * | * |

The symbol "*" in Table 3 indicates that an printing test was stopped due to remarkable turbulence and lack of uniformity of a thin layer over the entire surface of the developing sleeve.

It will be noted from Table 3 that the magnetic one-component toners of Examples 1 to 9, within the scope of the invention, can suppress the image density drop at the initial stage and after the printing test (after 100,000 printing), and these are high in transfer efficiency and free of fog, resulting in high image-quality image. In contrast, Comparative examples 1 to 12 caused the image density drop and fog, therefore the resulting image quality was poor and the transfer efficiency was low. The Comparative Examples 1 and 6 to 12 failed to obtain even an initial image due to a considerable turbulence of the toner thin layer on the developing sleeve. A brief annotation on the Comparative Examples 1 and 6 to 12 follows.

Specifically, the Comparative example 1 was the case where the toner mean roundness exceeded the upper limit of the invention; the Comparative Example 6 was the case where the toner means roundness was less than the lower limit of the invention; the Comparative Examples 7 and 8 were the cases where the abundance of phosphorous element in the used magnetic powder was less than the lower limit of the invention; the Comparative Examples 9 and 10 were the cases where the abundance of phosphorous element in the used magnetic powder exceeded the upper limit of the invention; and the Comparative Examples 11 and 12 were the cases where no phosphorous element was present in the used magnetic powder surface.

The present inventor concluded through the foregoing test that, among these factors contributing markedly to the formation of a toner thin layer, the most important factor is a phosphorous element in a magnetic powder, and the second most important factor is compressibility and roundness

What is claimed is:

1. An image forming apparatus comprising a developing sleeve made of stainless steel and a photosensitive material, wherein said image forming apparatus uses a magnetic one-component toner as a toner for developing an electrostatic latent image formed on the photosensitive material, wherein the magnetic one-component toner contains at least a binding resin and a magnetic powder, and has a volume average particle size of 6.0 to 9.0 μm, a compressibility of 15 to 50%, and a mean roundness of 0.950 to 0.960; and the magnetic powder has at its surface a phosphorus element of 0.10 to 0.50% by weight.

2. The image forming apparatus according to claim 1, further containing a coloring agent and a charge control agent and a wax, in addition to a binding resin and a magnetic powder.

3. The image forming apparatus according to claim 1, wherein the magnetic powder has an octahedral shape.

4. The image forming apparatus according to claim 3, wherein the magnetic powder has a number average particle size of 0.05 to 0.5 μm.

5. The image forming apparatus according to claim 1, wherein the magnetic powder is contained in an amount of 30 to 60% by weight in the toner.

6. The image forming apparatus according to claim 1, wherein the binding resin is a polyester resin obtained by condensation polymerization or co-condensation polymerization of an alcohol component and a carboxylic acid component.

7. The image forming apparatus according to claim 1, wherein the binding resin has a glass transition point (Tg) of 50 to 65° C.

8. The image forming apparatus according to claim 1, wherein the photosensitive material is an amorphous silicon photosensitive material.

* * * * *